US005431574A

United States Patent [19]

Shinchi

[11] Patent Number: 5,431,574

[45] Date of Patent: Jul. 11, 1995

[54] LEVER CONNECTION TYPE WATERPROOFING CONNECTOR

[75] Inventor: Akira Shinchi, Shizuoka, Japan

[73] Assignee: Yazaki Corporation, Tokyo, Japan

[21] Appl. No.: 194,397

[22] Filed: Feb. 10, 1994

[30] Foreign Application Priority Data

Feb. 10, 1993 [JP] Japan ..... 5-022735

[51] Int. Cl.[6] ..... H01R 13/62

[52] U.S. Cl. ..... 439/157; 439/271

[58] Field of Search ..... 439/152–157, 439/271, 372

[56] References Cited

U.S. PATENT DOCUMENTS

| | | | |
|---|---|---|---|
| 4,526,431 | 7/1985 | Kasukawa | 439/153 |
| 5,197,899 | 3/1993 | Akeda | 439/271 |
| 5,230,635 | 7/1993 | Takenouchi et al. | 439/153 |
| 5,240,431 | 8/1993 | Yagi et al. | 439/271 |

*Primary Examiner*—Larry I. Schwartz
*Assistant Examiner*—Jill DeMello
*Attorney, Agent, or Firm*—Sughrue, Mion, Zinn, Macpeak & Seas

[57] ABSTRACT

A lever connection type waterproofing connector includes a female connector housing, an engagement ring insertable into an inlet portion of the female connector housing, a sealing member, a lever rotatably supported on the female connector housing, and a male connector housing adapted to be connected to and disconnected from the female connector housing. To assure that the male connector housing can be properly connected to the female connector housing regardless of thermal deformation of the engagement ring, the waterproofing connector further includes two elongated cutout portions formed on the opposite sides of each receiving slit and extending in parallel with the receiving slit, two return stoppers disposed at the terminal ends of the cutout portions, two protuberances formed on the engagement ring, and two engagement portions integral with the engagement protuberance and having an engagement hole formed therethrough. Alternatively, the waterproofing connector may further include two engagement grooves recessed on the opposite sides of each receiving slit and extending in parallel with the receiving slit, two return stoppers disposed at the terminal ends of the engagement grooves, two engagement portions formed on the engagement ring, and two engagement pawls integrated with the engagement portions.

5 Claims, 5 Drawing Sheets

LEVER CONNECTION TYPE WATERPROOFING CONNECTOR

BACKGROUND OF THE INVENTION

1. Field of the Invention

The present invention relates to a lever connection type waterproofing connector for forming an electric circuit therewith. More particularly, the present invention relates to improvement of a lever connecting type waterproofing connector of the foregoing type which assures that a male connector housing can be properly fitted into a female connector housing regardless of thermal deformation of an engagement ring.

2. Background

To facilitate a better understanding of the present invention, a conventional connector of the above type will be described below with reference to FIGS. 6–8.

As shown in FIG. 6, the conventional connector includes as essential components a male connector housing a, a female connector housing c adapted to receive a fitting sleeve portion b of the male connector housing a in an inlet portion d thereof, a sealing member e adapted to be fitted in the bottom of the inlet portion d of the female connector housing c, and an engagement ring f adapted to be fitted into the inlet portion d of the female connector housing. In the clamped position, the sealing member e is elastically retained between the engagement ring f and the bottom wall of the inlet portion d of the female connector housing c.

As also shown in FIGS. 7 and 8, support shafts h are disposed on the opposite side walls of the female connector housing c for rotatably supporting a lever g. Additionally, receiving slits j are formed on the opposite side walls of the female housing for slidably receiving fitting protuberances i projecting outwardly from the opposite side walls of the fitting sleeve portion b of the male connector housing a.

Similarly, receiving slits j' are formed in the opposite side walls of the engagement ring f in alignment with the receiving slits j in the female connector housing c. Additionally, connecting slots k are formed in opposite side walls of the lever g. During the locking operation, the fitting protuberances i are initially slidably displaced along the receiving slits j of the female connector housing c and the receiving slits j' of the engagement ring f so that the protuberances are received in connecting slots K of the lever g. Thereafter, the lever is rotated causing the male connector housing to be inserted into the female connector housing by a camming action.

An external engagement arm m extends from a top wall of the engagement ring f, and an associated engagement recess n is formed on a top wall of the female connector housing c. With this construction, the engagement arm m of the engagement ring f engages the engagement recess n of the female connector housing c when the engagement ring f is fitted into the inlet portion d of the female connector housing c.

Usually, the male connector housing a, the female connector housing c and the engagement ring f are molded of a synthetic resin by employing an injection molding process. However, there sometimes arises a malfunction in that the opposite side walls of the engagement ring f, having long receiving slits j' formed therein, are thermally deformed in such a manner as to reduce the width of each receiving slit j' at the opened end portion as shown in FIG. 7 as a result of the heating of the engagement ring f during the injection-molding process.

As noted above, the receiving slits j' of the engagement ring f are formed in the opposite side walls of the engagement ring f in alignment with the receiving slits j of the female connector housing c, and moreover, the engagement arm m is disposed on the top wall of the engagement ring f. Thus, when the opposite side walls of the engagement ring f become thermally deformed, the leading end o of the inlet portion d of the female connector housing c becomes outwardly deformed beyond the outer peripheral wall of the engagement ring f when the engagement ring f is forcibly fitted into the female connector housing c. As a result, the engagement ring f is incorrectly fitted into the female connector housing c.

To assure that the engagement ring f is properly fitted into the female connector housing c, it is necessary that the thermally deformed state of the engagement ring f be corrected. Consequently, there arise problems in regard to the coupling of the connector so that the reliability of the connector is deteriorated.

SUMMARY OF THE INVENTION

The present invention has been made in consideration of the aforementioned background.

An object of the present invention is to provide a lever connection type waterproofing connector which assures that an engagement ring can be smoothly fitted into the inlet portion of a female connector housing.

Another object of the present invention is to provide a lever connection type waterproofing connector which is very reliable.

According to one aspect of the present invention, there is provided a lever connection type waterproofing connector including a female connector housing, an engagement ring to be inserted into an inlet portion of the female connector housing, a sealing member elastically fitted in the peripheral part of the bottom surface defining the inlet portion of the female connector housing, a lever rotatably disposed in the opposite side walls of the female connector housing, and a male connector housing to be connected to and disconnected from the female connector housing by rotatably actuating the lever. The waterproofing connector comprises two receiving slits formed through the opposite side walls of the female connector housing, two elongated cutout portions formed on the opposite sides of each receiving slit on the female connector housing while extending in parallel with the receiving slit, two return stoppers disposed in the form of protuberances at the terminal ends of the elongated cutout portions, two guiding slits formed through the opposite side walls of the engagement ring at the positions located in alignment with the receiving slits of the female connector housing, two elongated protuberances formed on each side wall of the engagement ring to be fitted into the elongated cutout portions on the female connector housing, two arm-shaped engagement portions each integrated with the engagement protuberance and having an engagement hole formed therethrough at the position located in alignment with each return stopper on the female connector housing, and two connecting slits formed on the opposite side walls of the lever so as to allow two fitting protuberances on the male connector housing to be slidably fitted into the connecting slits by rotatably actuating the lever.

To assure that the engagement ring can easily be inserted into the inlet portion of the female connector housing, it is desirable that a tapered part be formed at the foremost end of each elongated cutout portion on each side wall of the female connector housing.

In addition, according to another aspect of the present invention, there is provided a lever connection type waterproofing connector including a female connector housing, an engagement ring to be inserted into an inlet portion of the female connector housing, a sealing member elastically fitted to the peripheral part of the bottom surface defining the inlet portion of the female connector housing, a lever rotatably disposed in the opposite side walls of the female connector housing, and a male connector housing to be connected to and disconnected from the female connector housing by rotatably actuating the lever. The waterproofing connector comprises two receiving slits formed through the opposite side walls of the female connector housing, two engagement grooves recessed on each side wall of the female connector housing on the opposite sides of each receiving slit while extending in parallel with the receiving slit, two return stoppers disposed in the form of protuberances at the terminal ends of the engagement grooves, two guiding slits formed through the opposite side walls of the engagement ring at the positions located in alignment with the receiving slits of the female connector housing, two engagement portions formed on each side wall of the engagement ring to be slidably displaced along the engagement grooves of the female connector housing, two engagement pawls integrated with the engagement portions of the engagement ring to be engaged with the return stoppers on the female connector housing, and two connecting slits formed on the opposite side walls of the lever so as to allow two fitting protuberances on the male connector housing to be slidably fitted into the connecting slits by rotatably actuating the lever.

To assure that the return stoppers on the female connector housing are reliably engaged with the engagement portions on the engagement ring via the engagement pawls, it is desirable that each return stopper be projected toward a cable insertion portion of the female connector housing from the terminal end of each engagement groove located in the vicinity of the foremost end of each side wall of the female connector housing.

With the connection lever type waterproofing connector constructed in the above-described manner, in the case that there arises a malfunction that the engagement ring is thermally deformed on completion of an injection-molding operation in such a manner as to reduce the width of each guiding slit, the relative positions of the return stops relative to the engagement portions do not largely vary. Thus, the engagement ring can be properly inserted into the inlet portion of the connector housing regardless of the thermal deformation of the engagement ring without any possibility that each engagement ring fitting operation is incorrectly achieved.

Other objects, features and advantages of the present invention will become apparent from reading the following description which has been made in conjunction of the accompanying drawings.

BRIEF DESCRIPTION OF THE DRAWINGS

The present invention is illustrated in the following drawings in which.

DETAILED DESCRIPTION OF THE INVENTION

The present invention will now be described in detail hereinafter with reference to the accompanying drawings which illustrate preferred embodiments thereof.

Figure 1:
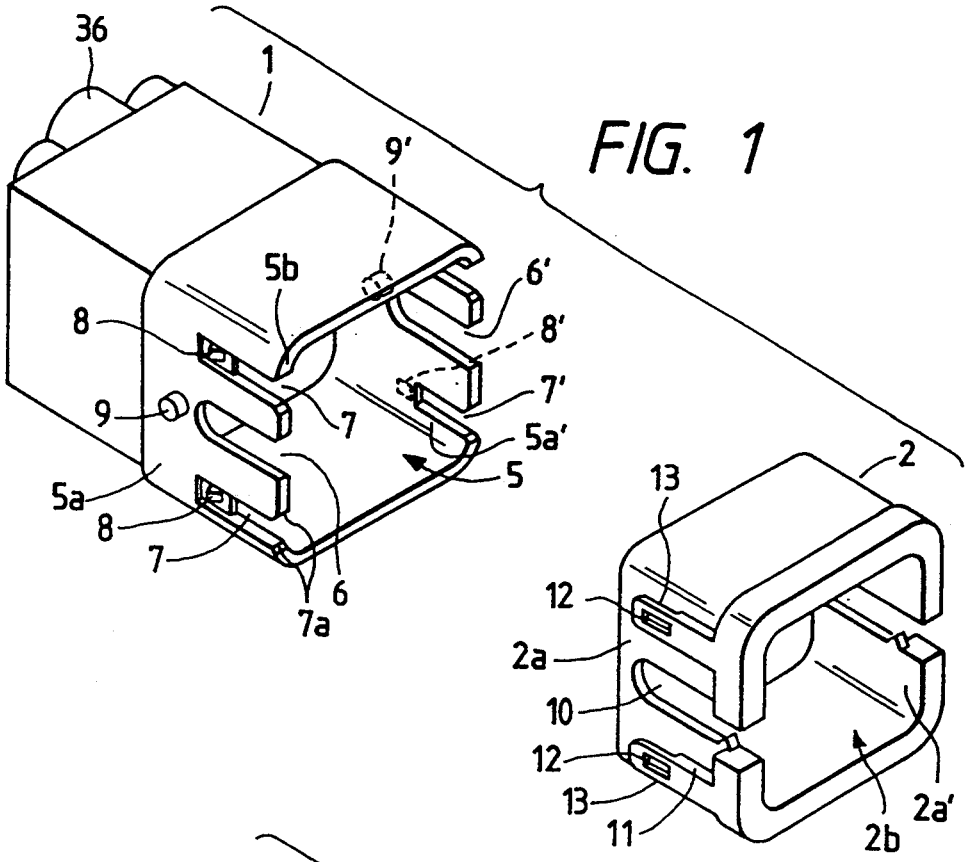
FIG. 1 is a perspective view of a lever connection type waterproofing connector constructed according to an embodiment of the present invention, particularly showing a female connector housing and an engagement ring in the disassembled state.
Figure 2:
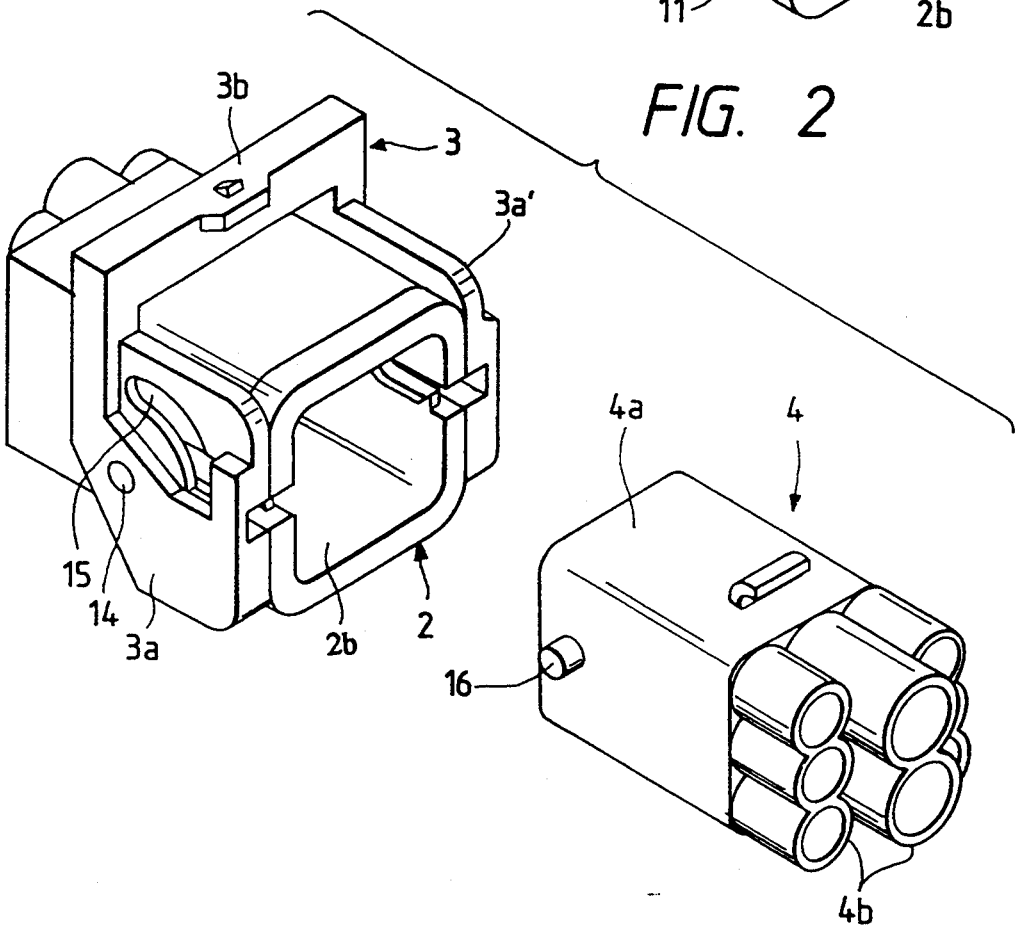
FIG. 2 is a perspective view of the female connector housing having the engagement ring shown in FIG. 1 inserted thereinto and a male connector housing wherein the latter is shown in the disassembled state.

FIG. 1 is a perspective view of a lever connection type waterproofing connector constructed according to an embodiment of the present invention, particularly showing a female connector housing 1 and an engagement ring 2 in the disassembled state, and FIG. 2 is a perspective view illustrating the female connector housing 1, the engagement ring 2 received in the female connector housing 1 and a lever 3 fitted to the opposite side walls of the female connector housing 1 as well as a male connector housing 4 to be fitted into the foregoing assembly.

As shown in FIG. 1, the female connector housing 1 includes a terminal receiving chamber (not shown), an inlet portion 5 having a rectangular cross-sectional shape on the right-hand end adapted to receive a fitting sleeve portion **4*a* of the male connector housing 4 therein, and a plurality of tubular cable insert portions 36** on the left-hand end thereof.

A receiving slit 6 is formed in a side wall **5*a* of the inlet portion 5 so as to extend toward an open end 5*b* of the inlet portion 5, and two rectangular elongated cutout portions 7 are formed in the same side wall 5*a* on opposite sides of the receiving slit 6 while extending in parallel with the receiving slit 6. The right-hand end of each rectangular elongated cutout portion 7** is open at the open end 5*b* of the inlet portion 5, and a return stopper 8 is disposed at the terminal end of each rectangular elongated cutout portion 7. A support shaft 9 projects outwardly from the side wall 5*a* for rotatably supporting the lever 3.

The opposing side wall 5*a*′ has a similar construction including receiving slit 6′, two rectangular elongated cutout portions 7′, two return stoppers 8′ and a support shaft 9′.

The engagement ring 2 has a rectangular cross-sectional shape so that the outer peripheral surface of the engagement ring 2 is in close contact with the inner wall surface of the inlet portion 5 of the female connector housing 1. A guiding slit 10 is formed in a side wall 2*a* of the engagement ring 2 at the position located in alignment with the receiving slit 6 of the female connector housing 1, two elongated protuberance 11 are formed on the side wall 2*a* so as to be inserted into the rectangular elongated cutout portions 7 on the female connector housing 1, and an arm-shaped engagement portion 13 having an engagement hole 12 formed therethrough at the position located in alignment with the return stopper 8 on the female connector housing 1 is disposed at the fore end part of each elongated protuberance 11. The engagement portions in cooperation with the return stoppers function to lock the engagement ring in the female connector housing. The opposite side wall 2*a*′ of the engagement ring 2 has a similar construction so that description thereof has been omitted.

After a sealing member (not shown) is fitted into the periphery of the bottom surface defining the inlet portion 5 of the female connector housing 1, the engagement ring 2 is inserted into the inlet portion 5 and thereafter, the lever 3 is forcibly fitted onto the support shafts 9 and 9′. At this time, an assembly consisting of the female connector housing 1, the engagement ring 2 and the lever 3 exhibits a configuration as shown on the left-hand side of FIG. 2.

The lever 3 includes driving portions 3*a* and 3*a*′ on the opposite sides thereof which are joined to each other via an actuating portion 3*b* to exhibit a substantially inverted U-shaped frame structure. Support holes 14 and 14′ are centrally provided in driving portions 3*a* and 3*a*′ for respectively receiving the support shafts 9 and 9′. Thus, the lever 3 is rotatably supported outside of the inlet portion 5 of the female connector housing 1 while the driving portions 3*a* and 3*a*′ are bridged between the opposite side walls of the female connector housing 1. The driving portions 3*a*, 3*a*′ include sector-shaped extensions in which arc-shaped connecting slits 15 are formed.

As shown in FIG. 2, the male connector housing 4 includes a fitting sleeve portion on the left-hand side and a plurality of tubular cable insert portions 4*b* on the right-hand side thereof, and a terminal receiving chamber (not shown) is formed in the male connector housing 4. Additionally, fitting protuberances 16 project from the opposite side walls of the fitting sleeve portion 4*a* of the male connector housing 4.

When the male connector housing 4 is fitted into the female connector housing 1, the fitting sleeve portion 4*a* of the male connector housing 4 is inserted into an opening portion 2*b* of the engagement ring 2. Subsequently, the fitting protuberances 16 on the male connector housing 4 are fitted into the guiding slits 10 and 10′ of the engagement ring 2, the receiving slits 6 and 6′ of the female connector housing 1, and connecting slits 15 of the lever 3. Thereafter, the lever 3 is rotated in the locking direction.

The connecting slits 15 of the lever 3 act as cam grooves, causing the fitting protuberances 16 on the male connector housing 4 to be slidably displaced along the guiding slits 10 and 10′ of the engagement ring 2 and the receiving slits 6 and 6′ of the female connector housing 1, whereby the fitting sleeve portion 4*a* of the male connector housing 4 is received in the inlet portion of the female connector housing 1 so as to allow the male connector housing 4 to be fitted into the female connector housing 1.

Figure 3:
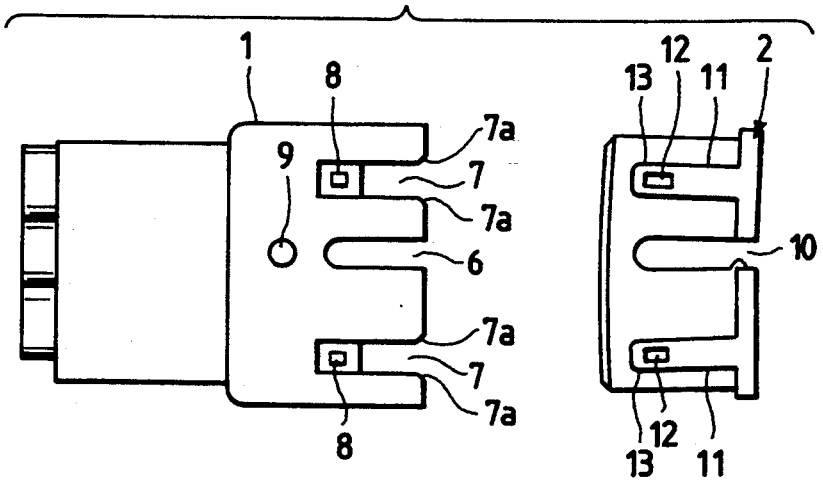
FIG. 3 is a side view of the female connector housing and the engagement ring shown in FIG. 1, particularly showing that the engagement ring is thermally deformed.

As noted above, during the injection molding process the engagement ring 2 may be thermally deformed in such a manner as to reduce the width of each of the guiding slits 10 and 10′, as shown in FIG. 3. However, since the location of the engagement portions 13 do not vary to any significant degree, the deformation of the engagement ring does not prevent it from being inserted into the inlet portion 5 of the female connector housing 1.

In order to facilitate insertion of the engagement ring 2 into the female connector housing 1, tapered portions 7*a* and 7*a*′ are formed at the foremost ends of the rectangular elongated cutout portions 7 and 7′ on the side walls 5*a* and 5*a*′. As a result, the elongated protuberances 11 of the engagement ring 2 can be easily fitted into the rectangular elongated cutout portions 7 and 7′.

Figure 4:
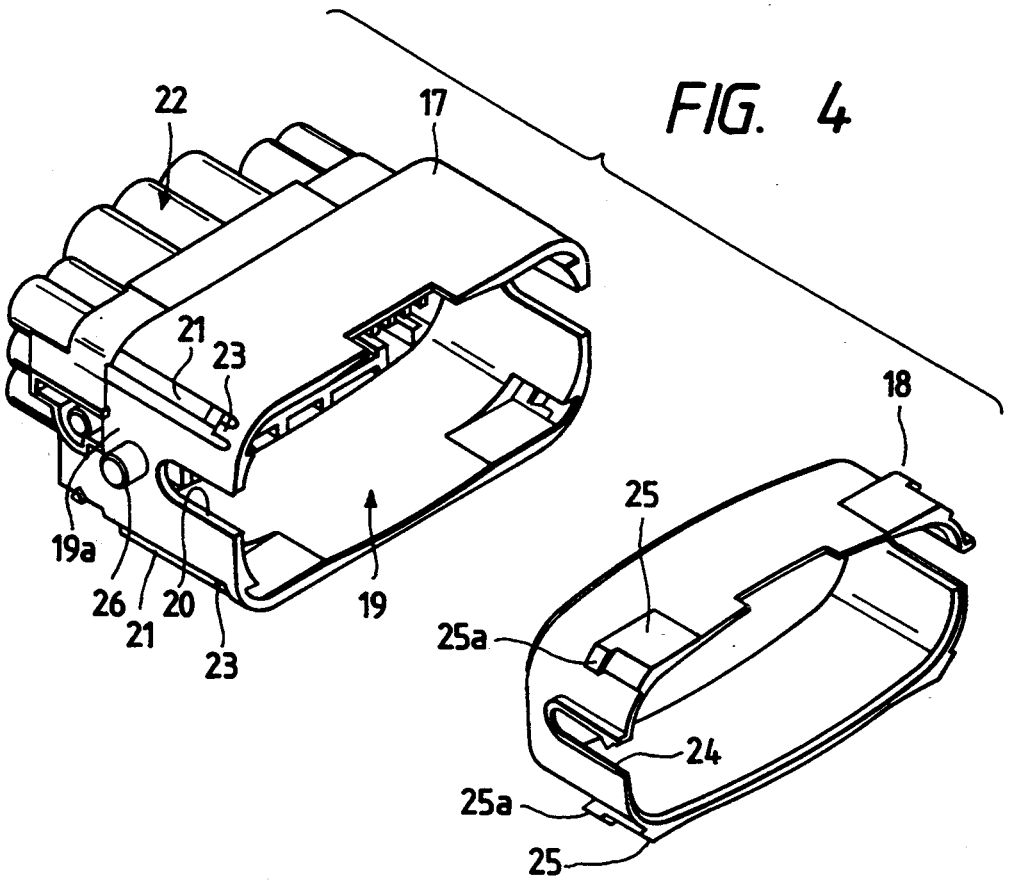
FIG. 4 is a perspective view of a lever connection type waterproofing connector constructed according to another embodiment of the present invention, particularly showing female connector housing and an engagement ring in the disassembled state.

FIG. 4 is a perspective view of a lever connection type waterproofing connector constructed according to another embodiment of the present invention, particularly showing a female connector housing 17 and an engagement ring 18 in the disassembled state.

The female connector housing 17 includes an inlet portion 19, and receiving slits 20 are formed in side walls 19*a* of the inlet portion 19. In addition, engagement grooves 21 extending from a position proximate the open end of the side wall 19*a* to the rear end of the side wall 19 are recessed on the opposite sides of each receiving slit 20 while extending parallel with the receiving slit 20. A return stopper 23 is disposed in each engagement groove 21 while projecting from the side wall 19*a* toward the cable insert portion 22 of the female connector housing 17.

On the other hand, guiding slits 24 are formed in side walls of the engagement ring 18, and engagement portions 25, each including an engagement pawl 25*a* to be engaged with the corresponding return stopper 23, project from the side walls of the engagement ring 18.

When the engagement ring 18 is inserted into the inlet portion 19 of the female connector housing 17, the engagement grooves 21 of the female connector housing 17 are first aligned with the engagement portions 25 of the engagement ring 18, and subsequently, the engagement ring 18 is press-fitted into the inlet portion 19 of the female connector housing 17. As the engagement portions 25 of the engagement ring 18 are slidably displaced along the engagement grooves 21, the engagement pawls 25*a* of the engagement portions 25 engage the foremost ends of the return stoppers 23, causing the engagement ring 18 to be received in the inlet portion 19 of the female connector housing 17 in the engaged state.

Figure 5:
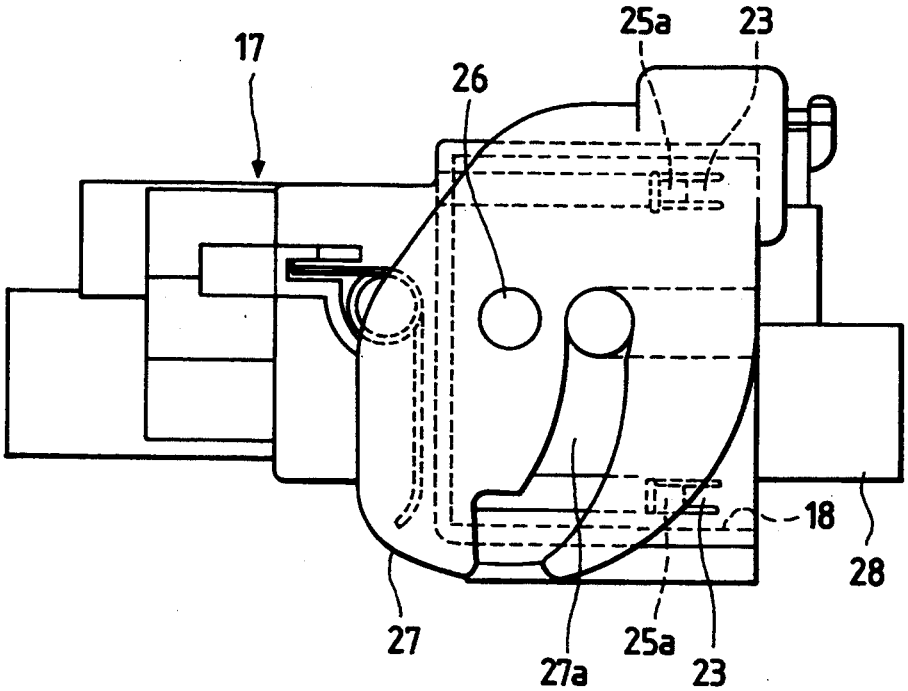
FIG. 5 is a side view of the waterproofing connector shown in FIG. 4, particularly showing the engagement ring inserted into the female connector housing, a lever fitted to the opposite side walls of the female connector housing, and a male connector housing fitted into the female connector housing.
Figure 6:
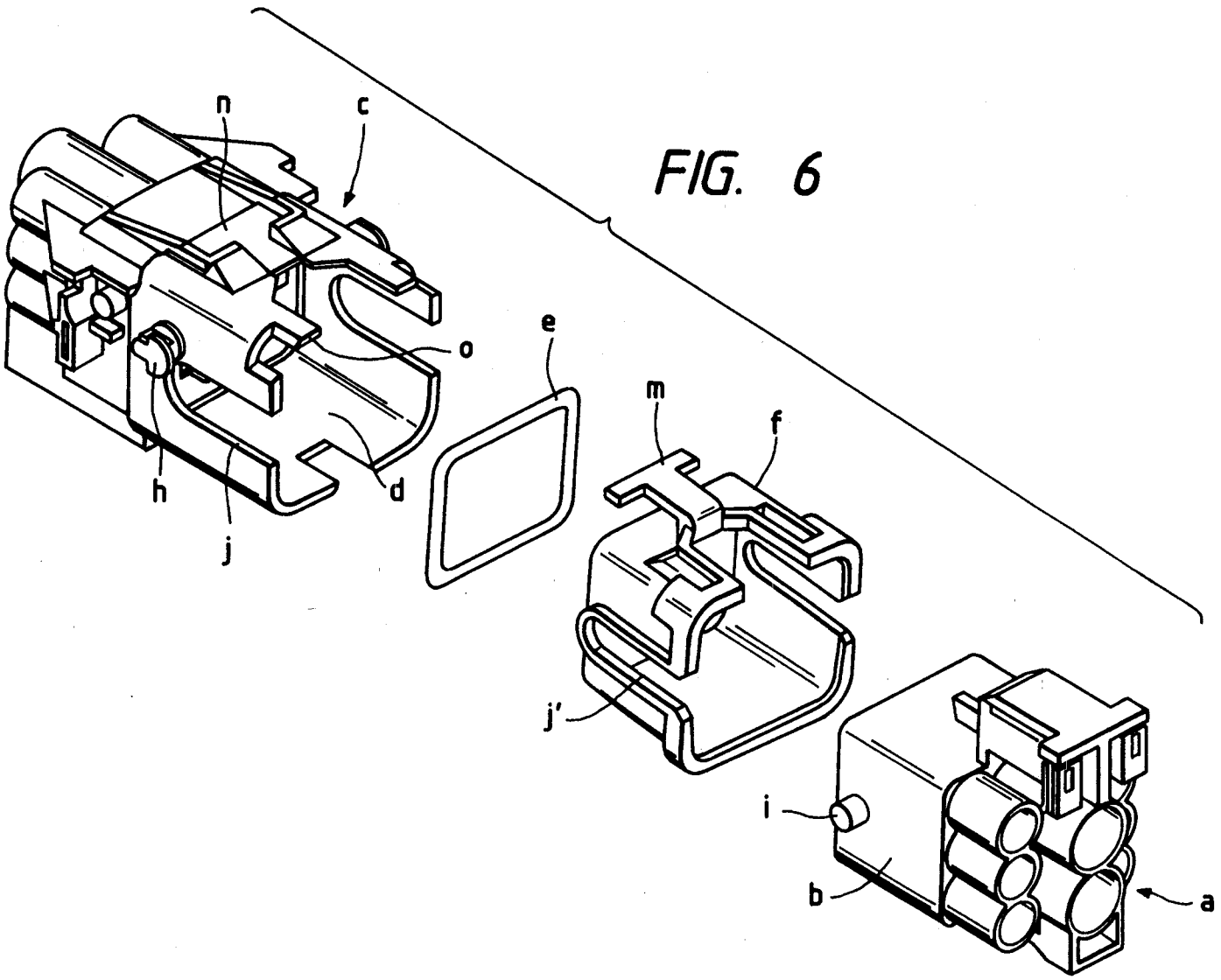
FIG. 6 is a perspective view of a conventional lever type waterproofing connector, particularly showing essential components constituting the connector in the disassembled state.
Figure 7:
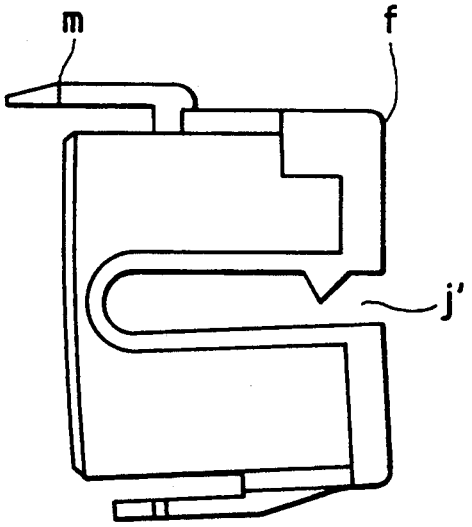
FIG. 7 is a side view of an engagement ring for the conventional connector shown in FIG. 6, particularly showing that the engagement ring is thermally deformed.
Figure 8:
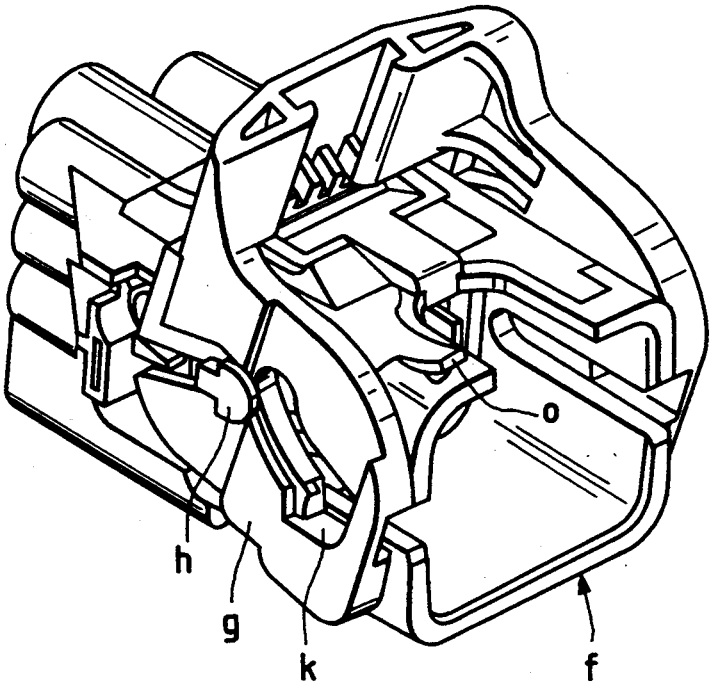
FIG. 8 is a perspective view of the conventional connector shown in FIG. 6, particularly showing a lever fitted to the opposite side walls of the female connector housing shown in FIG. 6, and the engagement ring is fitted into the female connector housing.

As shown in FIG. 5, a lever 27 having connecting slits 27*a* formed thereon is thermally fitted onto support shafts 26 projecting outside of side walls 19*a*. A male connector housing 28 having substantially the same structure as that of the male connector housing 4 in the preceding embodiment is fitted into the engagement ring 18, and thereafter, the lever 27 is rotated causing the male connector housing 28 and the female connector housing 17 to be interconnected.

Since the female connector housing 17 includes the return stoppers 23 in the engagement grooves 21 without any projection of the return stoppers 23 outside of the side walls 19*a* of the female connector housing 17, it is unlikely that an unexpected exterior force will be applied to the return stoppers 23. Thus, the waterproofing connector constructed in the above-described manner makes it possible to prevent the engagement ring 18 from being disengaged from the female connector housing 17 during practical use thereof.

While the present invention has been described above with respect to two preferred embodiments thereof, it should of course be understood that the present invention should not be limited only to these embodiments but various change or modification may be made without any departure from the scope of the present invention as defined by the appended claims.

What is claimed is:

1. A lever connection type waterproofing connector, comprising:

a male housing including opposing projections;

a female housing having an inlet portion for receiving said male housing, said inlet portion being partially defined by opposing side walls each having a receiving slit and a pair of elongated cut-outs respectively formed on opposite sides of said receiving slit and extending parallel thereto, a stopper being formed at a terminal end of each of said cutouts;

an engagement ring adapted to be inserted into said inlet portion of said female housing, said engagement ring including opposing side walls each having a guide slit formed therein in respective alignment with said receiving slits of said female housing, and a pair of elongated projections formed on each of said side walls of said engagement ring and adapted to be respectively received by said cutouts, each projection including an engagement portion which cooperates with an associated stopper for locking said engagement ring in said female housing;

a sealing member elastically fitted on a bottom surface defining said inlet portion of said female housing; and a lever rotatably disposed on opposite side walls of said female housing for urging said male housing into said female housing, said lever having a connecting slit formed on opposite side walls thereof for respectively receiving said projections of said male housing to cam said male housing into said inlet portion of said female housing by rotating said lever.

2. The lever connection type waterproofing connector according to claim 1, wherein a tapered portion is formed at the foremost end of each elongated cut-out on each side wall of said female connector housing.

3. A lever connection type waterproofing connector, comprising:

a male housing;

a female housing having an inlet portion for receiving said male housing, said inlet portion being partially defined by opposing side walls;

an engagement ring adapted to be inserted into said inlet portion of said female housing, said engagement ring including opposing side walls;

a sealing member elastically fitted on a bottom surface defining said inlet portion of said female connector housing and sandwiched by said engagement ring;

locking means for locking said engagement ring in said inlet portion of said female housing, both said locking means being respectively provided on said side walls of said female housing and both said side walls of said engagement ring; and cam means for camming said male housing into said inlet portion of said female housing.

4. The lever connection type waterproofing connector according to claim 5, wherein said locking means comprises:

a pair of longitudinally extending recessed portions provided in each of said side walls of said female housing;

a return stopper provided at a terminal end of each of said recessed portions;

a pair of longitudinally extending projections provided on each of said side walls of said engagement ring and including an engagement projection extending therefrom which is respectively engageable with said return stoppers when said engagement ring is inserted into said inlet portion of said female housing.

5. The lever connection type waterproofing connector of claim 4, wherein said recessed portions extend through said side walls of said female housing.

* * * * *

UNITED STATES PATENT AND TRADEMARK OFFICE

CERTIFICATE OF CORRECTION

PATENT NO. : 5,431,574

DATED : July 11, 1995

INVENTOR(S) : Akira Shichi

It is certified that error appears in the above-indentified patent and that said Letters Patent is hereby corrected as shown below:

Column 8, line 32, delete "5", insert --3--.

Signed and Sealed this

Twelfth Day of March, 1996

Bruce Lehman

*Attest:*

BRUCE LEHMAN

*Attesting Officer*

*Commissioner of Patents and Trademarks*